United States Patent [19]

Vecchiarelli

[11] 4,254,814

[45] Mar. 10, 1981

[54] VENETIAN BLIND AND A VALANCE BRACKET THEREFOR

[75] Inventor: Francis Vecchiarelli, River Edge, N.J.

[73] Assignee: Hunter Douglas International N.V., Netherlands Antilles

[21] Appl. No.: 50,315

[22] Filed: Jun. 20, 1979

[51] Int. Cl.[3] ..... E06B 9/00

[52] U.S. Cl. ..... 160/19; 160/38

[58] Field of Search ..... 160/19, 38, 39, 178 R; 16/94 D

[56] References Cited

U.S. PATENT DOCUMENTS

| | | | |
|---|---|---|---|
| 2,706,521 | 4/1955 | Nelson | 160/38 |
| 3,983,600 | 10/1976 | Smith | 160/38 |
| 4,079,770 | 3/1978 | Woodle | 160/39 |

FOREIGN PATENT DOCUMENTS

| | | | |
|---|---|---|---|
| 206528 | 8/1966 | Sweden | 160/38 |

*Primary Examiner*—Peter M. Caun

*Attorney, Agent, or Firm*—Pennie & Edmonds

[57] ABSTRACT

A horizontal venetian blind and a valance bracket therefor, in which the bracket is formed as a unitary structure formed in one single piece, and including a main body dimensioned to bridge the gap between the rims at the top of the front and rear walls of the headrail of the blind, an end portion at one end of the body overlying one of the rims. One or more tongues are cantilevered from the body at a location spaced from the one end, the tongues being located below and extending away from the body at an acute angle thereto, either sideways or downwardly, and being resiliently engageable on the one rim of the blind. An abutment member extends downwardly from the body and has an inclined surface which lockingly engages under the other rim of the headrail and is urged thereagainst by the resilient interaction between the rim and the tongue or tongues. The valance support member is connected to the main body to depend in front of the headrail when the bracket is mounted thereon.

10 Claims, 6 Drawing Figures

VENETIAN BLIND AND A VALANCE BRACKET THEREFOR

BACKGROUND OF THE INVENTION

The present invention relates to a horizontal venetian blind and to valance brackets therefor.

Horizontal venetian blinds, that is to say blinds which include horizontal slats, usually have a headrail formed as a generally channel cross-section member, with a lower web and front and rear walls each terminating in an upper rim, the rims having a gap therebetween.

In recent years it has become fashionable to mount a valance in front of the headrail to make it look more attractive. Various forms of bracket have been proposed for mounting such valances in position and these valances themselves are often formed of material similar to the slats of the venetian blind itself. The brackets which have previously been proposed are rather cumbersome and expensive and are generally not very easy to mount and dismount from the headrail.

SUMMARY OF THE INVENTION

It is now proposed, according to the present invention, to provide a valance bracket for a horizontal venetian blind having a generally channel cross-section headrail, with a lower web and front and rear walls each terminating in an upper rim, whereby the rims have a gap therebetween, said bracket comprising, as a unitary structure formed in one single piece, a main body dimensioned to bridge the gap between said rims, an end portion at one end of said body adapted to overlie one of said rims, at least one tongue cantilevered from said body at a location spaced from said one end, said tongue being located below said body and extending away from said body at an acute angle thereto, and being resiliently engageable on said one rim, an abutment member extending downwardly from said body at a location spaced from said one end and having an abutment surface on the side remote from said one end which is inclined downwardly away from said one end, to lockingly engage said other rim and be urged thereagainst by the resilient interaction between said one rim and said at least one tongue, and a valance support member connected to said main body to depend in front of said headrail when said bracket is mounted thereon.

Such a construction can be formed as a single unitary structure, for example, by stamping from sheet metal or by moulding from plastics material. The bracket can then readily be manufactured and is easy to put into place on the venetian blind headrail.

The tongue or tongues may be provided at the same end of the main body of the bracket as is the valance support member in which case the abutments can be engaged under the said other rim, that is the rear rim of the blind, the bracket pivoted downwardly and forwardly so that the tongue or tongues spring out sideways slightly as they are passed over the one rim, that is the front rim. The resilience of the tongues then urges the abutment against the rear rim.

With this arrangement, therefore, it is advantageous that the said at least one tongue should extend sideways from the body at an acute angle thereto. Such an arrangement can be achieved by there being at least one side flange which extends downwardly from the body, said side flange terminating at said one end of the body in said tongue, the other end of said side flange forming said downwardly inclined abutment surface.

In one arrangement, there are two side flanges which extend downwardly, one from each side of the body, said side flanges each terminating at said one end in said tongues, the other ends of said side flanges each forming part of said downwardly inclined abutment surface.

Alternatively, said one tongue can be downwardly inclined at an acute angle from the body to extend below said end portion. In this case the tongue and end portion are preferably arranged to be at the opposite end from the valance support member and the assembly is put in place by engaging the tongue under the rear wall rim of the headrail and the bracket is then pivoted downwardly until the abutments engage under the front rim which can, if necessary, be pulled forward slightly to assist this in happening. Alternatively, a backward pushing action can be exerted to pivot the rear wall of the headrail backwardly to enable the abutment to engage under the front rim of the headrail.

The invention also provides a horizontal venetian blind comprising a generally channel cross-section headrail, with a lower web and front and rear walls, each terminating in an upper rim, whereby the rims have a gap therebetween, a valance support bracket comprising, as a unitary structure formed in one single piece, a main body dimensioned to bridge the gap between said rims, an edge portion at one end of said body adapted to overlie one of said rims, at least one tongue cantilevered from said body at a location spaced from said one end, said tongue being located below said body and extending away from said body at an acute angle thereto and being resiliently engaged on said one rim, an abutment member extending downwardly from said body at a location spaced from said one end and having an abutment surface on the side remote from said one end which is inclined downwardly away from said one end, to lockingly engage said other rim and be urged thereagainst by the resilient interaction between said one rim and said at least one tongue, and a valance support member connected to said main body to depend in front of said headrail.

The construction of horizontal venetian blind and valance holding bracket therefor, according to the invention, has a number of advantages over that of the prior known constructions. Because of the provision of the tongue, the resilience which is necessary to hold the bracket in place under the rims of the front and rear walls of the headrail is shared between the headrail and the bracket. In prior arrangements the resilience is provided solely by the headrail itself.

Thus, with the construction of the invention the tolerances of the dimensions of the bracket and the gap between the rims of the headrail are not so critical. Many components are located in a venetian blind headrail, such as ladder tape rope, tilter mechanism, cord locks. These are usually all held in place by the rims of the headrail. The valance bracket with the valance thereon is necessarily the last component to be fitted and is fitted after the blind is put in place. If the bracket were to flex the rims apart, then the previously mounted parts would tend to rattle. The bracket of this invention tends to reduce this problem because of the resilience of the tongues.

A stop is advantageously arranged to extend rearwardly from the valance support member generally towards the body to abut the front wall of the headrail. This first of all prevents sagging of the valance and keeps the latter substantially vertical. Secondly, it reduces the tendency of the bracket to pivot downwardly and thus reduces the possibility of the weight of the valance causing the tongue or the abutment surface disengaging from the rear rim of the headrail.

In order that the invention may more readily be understood, the following description is given, merely by way of example, reference being made to the accompanying drawings, which illustrate certain embodiments of the invention.

DETAILED DESCRIPTION OF PREFERRED EMBODIMENTS

Figure 1:
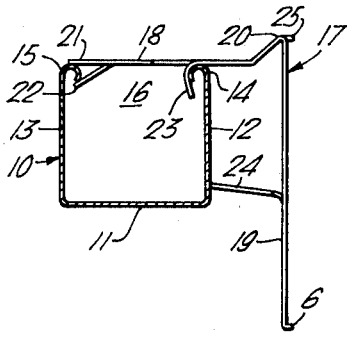
FIG. 1 is an end elevation of a venetian blind headrail according to the invention with a valance bracket put in place.

Referring first to the presently preferred mode of putting the invention into effect illustrated in FIGS. 1 to 4 of the accompanying drawings, there is illustrated therein a horizontal venetian blind headrail of conventional design, this headrail being indicated by the general reference numeral 10. The headrail is of generally channel section form having a lower web portion 11 and front and rear walls 12 and 13. The front wall 12 has a rim 14 and the rear wall a similar rim 15, these rims being spaced by a gap 16.

The valance bracket according to the invention is indicated by the general reference numeral 17. The valance bracket is formed as a unitary structure in one single piece, preferably by stamping from sheet metal and includes a main body portion 18 which is dimensioned to bridge the gap 16 indicated above.

Connected to the forward end of the main body 18 is a valance support member 9 which is connected thereto by a swan neck portion 20. The body 18 has, at one end, that is the lefthand end illustrated in FIG. 1, an end portion 21, which overlies, in use, the rear rim 15. A downwardly inclined tongue 22 extends at an acute angle to the end portion 21, which, as can be seen particularly from FIG. 2, is in two parts, one on either side of the tongue 22.

At the other end of the body portion 18, flanges 23 are bent down on each side of the main body portion 18. It will be noted that these flanges are bent downwardly so that their surface remote from the end 21 are inclined downwardly and away from the end 21. The valance support member 19 has, at about the centre of its height, a stop member 24 bent rearwardly down therefrom. At its front, the support member 19 has a short central projection 25 and a ridge 26 along its lower edge. One or more valance strips (not shown) may be located between the members 25 and 26 and held in place, for example, by double sided adhesive strip.

Figure 3:
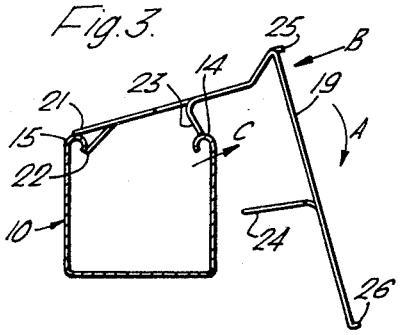
FIG. 3 is a view similar to FIG. 1 showing the bracket being put in place.
Figure 4:
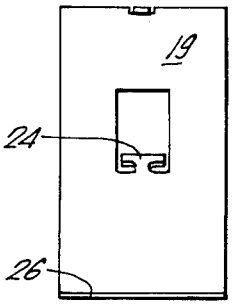
FIG. 4 is a front elevation of the bracket of FIGS. 1, 2 and 3.

In order to mount the bracket on the headrail 10, the tongue 22 is engaged under the rim 15 as indicated in FIG. 3. A pivoting motion as indicated by the arrow A can be carried out which causes the rim 14 to snap behind the abutment lugs 23. The same affect can be achieved by pushing in the direction of the arrow B and slightly bending out the rim 14 forwardly. The stop 24 retains the valance support member 19 in a substantially vertical plane.

Figure 5:
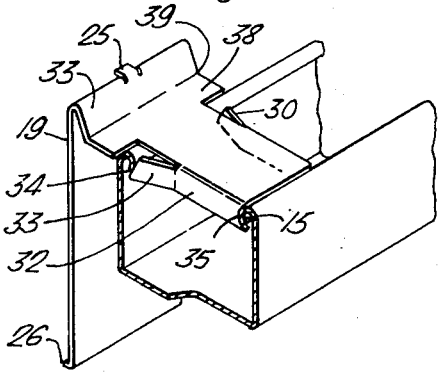
FIG. 5 is a perspective view illustrating a second embodiment of bracket according to the invention, being put in place.

The valance support 30 illustrated in FIG. 5 comprises a main body portion 31 having two side flanges 32 only one of which can be seen in FIG. 5. Each of the side flanges is provided, at one end, that is the left upper end illustrated in FIG. 5, with a sidewardly inclined flange 33 which is inclined at an acute angle to the body 31 and extends therebelow. The free edge 34 of each tongue is inclined downwardly towards said one end of the main portion 31.

At the other end of the two flanges 32 are provided with arcuate recesses 35, the lower portion of which, therefor, extends downwardly and away from the end portion 34.

Figure 2:
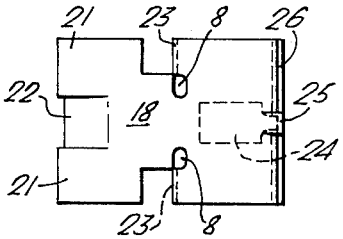
FIG. 2 is a plan view of the valance bracket shown in FIG. 1.

The body 31 is extended at 38 and is provided with a swan neck 39 similar to that illustrated in FIG. 1. The swans neck has similar elements 24, 25 and 26 to that illustrated in FIG. 1 for the same purpose.

When the bracket is mounted on the headrail the recess portion 35 is engaged under the rear rim 15 of the blind and the assembly is pivoted downwardly so that the tongues 33 flex outward slightly and the front wall 12 and its rim 14 also flex forwardly slightly to allow the tongue to engage under the rim, with the rim abutting the inclined surface 34. Thus the surfaces 34 and 35 locate the bracket in position and the stop 24 holds the valance support member 19 vertically in front of the wall 12.

Figure 6:
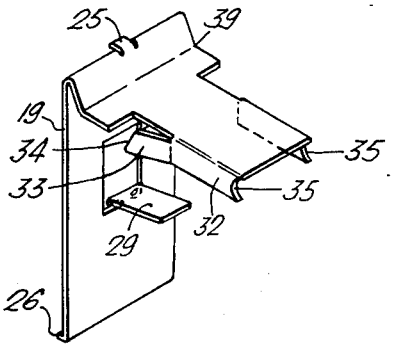
FIG. 6 is a similar view of a modified form of bracket to that illustrated in FIG. 5.

The construction of FIG. 6 is very similar to that of FIG. 5 except that one of the tongues 33 has been omitted. This construction can be fitted in the same manner as indicated above, or can be fitted by a pivoting motion about a vertical axis which is made possible by the absence of the second tongue 33.

I claim:

1. A valance bracket for a horizontal venetian blind having a generally channel cross-section headrail, with a lower web and front and rear walls each terminating in an upper rim, whereby the rims have a gap therebetween, said bracket comprising, as a unitary structure formed in one single piece, a main body dimensioned to bridge the gap between said rims, an end portion at one end of said body adapted to overlie one of said rims, at least one tongue cantilevered from said body at a location spaced from said one end, said tongue being located below said body and extending away from said body at an acute angle thereto, and being resiliently engageable on said one rim, an abutment member extending downwardly from said body at a location spaced from said one end and having an abutment surface on the side remote from said one end which is inclined downwardly away from said one end, to lockingly engage said other rim and be urged thereagainst by the resilient interaction between said one rim and said at least one tongue, and a valance support member connected to said main body to depend in front of said headrail when said bracket is mounted thereon.

2. A valance bracket as claimed in claim 1, wherein said at least one tongue extends sideways from said body at an acute angle thereto.

3. A valance bracket as claimed in claim 2 and further comprising at least one side flange extending downwardly from said body, said side flange terminating at said one end of said body in said tongue, the other end of said flange forming said downwardly inclined abutment surface.

4. A valance bracket as claimed in claim 2, wherein there are two of said tongues, one extending sideways from each side of said body at an acute angle thereto.

5. A valance bracket as claimed in claim 4, and further comprising a side flange extending downwardly from each side of said body, said side flanges terminating at said one end in said tongues, the other ends of said side flanges each forming part of said downwardly inclined abutment surface.

6. A valance bracket as claimed in claim 1, wherein said tongue is downwardly inclined at an acute angle from said body to extend below said end portion.

7. A valance bracket as claimed in claim 1 and further comprising a stop extending rearwardly from said valance support member generally towards said body, said stop abutting the front wall of the venetian blind headrail to space said valance support member therefrom.

8. A horizontal venetian blind comprising a generally channel cross-section headrail, with a lower web and front and rear walls, each terminating in an upper rim, whereby the rims have a gap therebetween, a valance support bracket comprising, as a unitary structure formed in one single piece, a main body dimensioned to bridge the gap between said rims, an edge portion at one end of said body adapted to overlie one of said rims, at least one tongue cantilevered from said body at a location spaced from said one end, said tongue being located below said body and extending away from said body at an acute angle thereto and being resiliently engaged on said one rim, an abutment member extending downwardly from said body at a location spaced from said one end and having an abutment surface on the side remote from said one end which is inclined downwardly away from said one end, to lockingly engage said other rim and be urged thereagainst by the resilient interaction between said one rim and said at least one tongue, and a valance support member connected to said main body to depend in front of said headrail.

9. A horizontal venetian blind as claimed in claim 8, wherein said main body of said valance bracket further comprises a side flange extending downwardly from each side of said body, said side flanges each terminating at said one end in said tongues which extend sideways from each side of said body at an acute angle thereto, the other end of said side flanges each forming part of said downwardly inclined abutment surface.

10. A horizontal venetian blind as claimed in claim 8, wherein said tongue of said valance bracket is downwardly inclined at an acute angle from the main body of said bracket to extend below said end portion and under said one rim of said headrail.

* * * * *